US011419468B2

(12) United States Patent
Rougher et al.

(10) Patent No.: US 11,419,468 B2
(45) Date of Patent: Aug. 23, 2022

(54) DIRT SEPARATION DEVICE

(71) Applicant: TTI (MACAO COMMERCIAL OFFSHORE) LIMITED, Macau (CN)

(72) Inventors: Simon Matthew Rougher, Chester (GB); Darren Holmes, Birmingham (GB); Richard Waters, Birmingham (GB); Anna Jaanus, Birmingham (GB); Jose Casella, Birmingham (GB)

( * ) Notice: Subject to any disclaimer, the term of this patent is extended or adjusted under 35 U.S.C. 154(b) by 291 days.

(21) Appl. No.: 16/624,676

(22) PCT Filed: Jun. 15, 2018

(86) PCT No.: PCT/GB2018/051657

§ 371 (c)(1),
(2) Date: Dec. 19, 2019

(87) PCT Pub. No.: WO2018/234759

PCT Pub. Date: Dec. 27, 2018

(65) Prior Publication Data

US 2020/0170467 A1 Jun. 4, 2020

(30) Foreign Application Priority Data

Jun. 19, 2017 (WO) ..... PCT/GB2017/051786
Jun. 19, 2017 (WO) ..... PCT/GB2017/051788
Dec. 5, 2017 (GB) ..... 1720290

(51) Int. Cl.
*A47L 9/16* (2006.01)
*A47L 5/24* (2006.01)
(Continued)

(52) U.S. Cl.
CPC ..... *A47L 9/1616* (2013.01); *A47L 5/24* (2013.01); *A47L 5/28* (2013.01); *A47L 5/36* (2013.01);
(Continued)

(58) Field of Classification Search
CPC ..... A47L 5/12; A47L 5/24; A47L 5/26; A47L 9/10; A47L 9/14; A47L 9/1409;
(Continued)

(56) References Cited

U.S. PATENT DOCUMENTS 4,851,019 A 7/1989 Ahlf et al.
4,961,765 A 10/1990 Guhne et al.
(Continued)

FOREIGN PATENT DOCUMENTS

AU 201618861 1/2017
AU 201710096 1/2017
(Continued)

OTHER PUBLICATIONS

International Search Report and Written Opinion for Application No. PCT/GB2018/051657 dated Sep. 28, 2018 (10 pages).

*Primary Examiner* — Orlando E Aviles
*Assistant Examiner* — Sidney D Hohl
(74) *Attorney, Agent, or Firm* — Michael Best & Friedrich LLP

(57) ABSTRACT

A dirt separation device for a surface cleaning apparatus including: a separator for separating dirt from dirt-laden air; an inlet through which dirt-laden air is drawn into the separator; an outlet through which cleaner air exits the separator; a dirt collection chamber for receiving separated dirt; a cover member movable between a first position in which the cover member inhibits access to the dirt collection chamber and a second position in which the cover member permits access to the dirt collection chamber; an actuator device coupled to the cover member for effecting movement of the cover member from the first position to the second position, wherein the actuator device is rotationally movable, or an engagement part operably connected to the actuator device is rotationally movable, to effect movement
(Continued)

of the closing member from the first position to the second position.

21 Claims, 13 Drawing Sheets

(51) Int. Cl.

| | |
|---|---|
| ***A47L 9/10*** | (2006.01) |
| ***A47L 9/14*** | (2006.01) |
| ***A47L 5/28*** | (2006.01) |
| ***A47L 5/36*** | (2006.01) |
| ***A47L 9/32*** | (2006.01) |
| ***A47L 9/24*** | (2006.01) |
| ***B04C 5/187*** | (2006.01) |
| ***B04C 5/26*** | (2006.01) |

(52) U.S. Cl.
CPC ..... *A47L 9/102* (2013.01); *A47L 9/1409* (2013.01); *A47L 9/1481* (2013.01); *A47L 9/165* (2013.01); *A47L 9/1608* (2013.01); *A47L 9/1633* (2013.01); *A47L 9/1658* (2013.01); *A47L 9/1683* (2013.01); *A47L 9/1691* (2013.01); *A47L 9/242* (2013.01); *A47L 9/322* (2013.01); *A47L 9/327* (2013.01); *B04C 5/187* (2013.01); *B04C 5/26* (2013.01)

(58) Field of Classification Search
CPC .... A47L 9/1427; A47L 9/1436; A47L 9/1445; A47L 9/1463; A47L 9/149; A47L 9/16–1625; A47L 9/1683; A47L 9/1691; A47L 5/28; A47L 5/36; A47L 9/102; A47L 9/1481; A47L 9/242; A47L 9/322; A47L 9/327; A47L 9/1633; A47L 9/1658; B04C 5/187
See application file for complete search history.

(56) References Cited

U.S. PATENT DOCUMENTS

| | | | |
|---|---|---|---|
| 6,085,382 | A | 7/2000 | Bobrosky et al. |
| 6,308,374 | B1 | 10/2001 | Br |
| 6,484,352 | B2 | 11/2002 | Huebsch et al. |
| 6,536,072 | B2 | 3/2003 | Thur et al. |
| 6,553,611 | B2 | 4/2003 | Huebsch et al. |
| 6,810,558 | B2 | 11/2004 | Lee |
| 6,991,667 | B2 | 1/2006 | Yang et al. |
| 7,014,675 | B2 | 3/2006 | Nakai et al. |
| 7,175,682 | B2 | 2/2007 | Nakai et al. |
| D552,309 | S | 10/2007 | Houghton |
| 7,293,326 | B2 | 11/2007 | Hawkins et al. |
| 7,325,274 | B2 | 2/2008 | Jeong |
| D569,061 | S | 5/2008 | Nardone |
| 7,370,387 | B2 | 5/2008 | Walker et al. |
| 7,380,308 | B2 | 6/2008 | Oh et al. |
| 7,462,210 | B2 | 12/2008 | Lee |
| 7,555,808 | B2 | 7/2009 | Oh et al. |
| 7,637,184 | B2 | 12/2009 | Moon et al. |
| 7,655,060 | B2 | 2/2010 | Nakai et al. |
| 7,810,210 | B2 | 10/2010 | Yoo et al. |
| 7,950,104 | B2 | 5/2011 | Yoo |
| D640,847 | S | 6/2011 | Houghton |
| 7,979,953 | B2 | 7/2011 | Yoo |
| 7,981,181 | B2 | 7/2011 | Yoo |
| 8,028,373 | B2 | 10/2011 | Rowntree |
| RE42,873 | E | 11/2011 | Walker et al. |
| 8,141,202 | B2 | 3/2012 | Hawkins et al. |
| 8,146,201 | B2 | 4/2012 | Conrad |
| 8,151,407 | B2 | 4/2012 | Conrad |
| 8,156,609 | B2 | 4/2012 | Milne et al. |
| 8,181,309 | B2 | 5/2012 | Mersmann et al. |
| 8,191,203 | B2 | 6/2012 | Yoo |
| 8,234,750 | B2 | 8/2012 | Hawkins et al. |
| 8,236,077 | B2 | 8/2012 | Gomiciaga-Pereda et al. |
| 8,296,900 | B2 | 10/2012 | Conrad |
| RE43,804 | E | 11/2012 | Walker et al. |
| 8,359,705 | B2 | 1/2013 | Conrad |
| 8,444,731 | B2 | 5/2013 | Gomiciaga-Pereda et al. |
| 8,505,160 | B2 | 8/2013 | Yoo |
| 8,578,555 | B2 | 11/2013 | Conrad |
| 8,590,102 | B2 | 11/2013 | Conrad |
| 8,650,707 | B2 | 2/2014 | Hawkins et al. |
| 8,661,610 | B2 | 3/2014 | Liu et al. |
| 8,677,558 | B2 | 3/2014 | Conrad |
| 8,707,509 | B2 | 4/2014 | White et al. |
| 8,728,186 | B2 | 5/2014 | Kim et al. |
| 8,752,239 | B2 | 6/2014 | Conrad |
| 8,813,305 | B2 | 8/2014 | Conrad |
| 8,844,093 | B2 | 9/2014 | Conrad |
| 8,869,344 | B2 | 10/2014 | Conrad |
| 8,918,952 | B2 | 12/2014 | Rowntree |
| 8,925,145 | B2 | 1/2015 | Wilson |
| D726,383 | S | 4/2015 | Milligan |
| 9,009,914 | B2 | 4/2015 | Tran |
| 9,027,201 | B2 | 5/2015 | Conrad |
| 9,066,643 | B2 | 6/2015 | Conrad |
| 9,078,549 | B2 | 7/2015 | Conrad |
| 9,084,522 | B2 | 7/2015 | Conrad |
| 9,084,523 | B2 | 7/2015 | Conrad |
| 9,084,524 | B2 | 7/2015 | Conrad |
| 9,095,245 | B2 | 8/2015 | Conrad |
| 9,119,513 | B2 | 9/2015 | Conrad |
| 9,119,514 | B2 | 9/2015 | Conrad |
| 9,192,269 | B2 | 11/2015 | Conrad |
| 9,259,126 | B2 | 2/2016 | Niederman |
| 9,265,395 | B2 | 2/2016 | Conrad |
| 9,301,666 | B2 | 4/2016 | Conrad |
| 9,314,139 | B2 | 4/2016 | Conrad et al. |
| 9,320,397 | B2 | 4/2016 | Gotschall et al. |
| 9,420,925 | B2 | 8/2016 | Conrad et al. |
| 9,451,853 | B2 | 9/2016 | Conrad et al. |
| 9,451,858 | B2 | 9/2016 | Stickney et al. |
| 9,475,164 | B2 | 10/2016 | Simm et al. |
| 9,565,981 | B2 | 2/2017 | Conrad et al. |
| 9,585,530 | B2 | 3/2017 | Conrad et al. |
| 9,661,964 | B2 | 5/2017 | Conrad et al. |
| 2006/0225243 | A1 | 10/2006 | Kim |
| 2007/0094837 | A1 | 5/2007 | Jeon et al. |
| 2007/0209146 | A1 | 9/2007 | Mersmann et al. |
| 2008/0172992 | A1 | 7/2008 | Conrad |
| 2008/0256744 | A1 | 10/2008 | Rowntree et al. |
| 2010/0299865 | A1 | 12/2010 | Conrad |
| 2011/0056045 | A1 | 3/2011 | Sepke et al. |
| 2011/0146024 | A1 | 6/2011 | Conrad |
| 2011/0146719 | A1 | 6/2011 | Randall |
| 2012/0222251 | A1 | 9/2012 | Conrad |
| 2014/0366313 | A1 | 12/2014 | Conrad |
| 2015/0182085 | A1 | 7/2015 | Tran et al. |
| 2015/0208885 | A1 | 7/2015 | Conrad |
| 2015/0289736 | A1 | 10/2015 | Rowntree |
| 2015/0289738 | A1 | 10/2015 | Tran |
| 2016/0113455 | A1 | 4/2016 | Horvath et al. |
| 2016/0198915 | A1 | 7/2016 | Conrad |
| 2016/0198916 | A1 | 7/2016 | Conrad |
| 2016/0215516 | A1* | 7/2016 | Hayes ..... B04C 9/00 |
| 2016/0242609 | A1 | 8/2016 | Conrad |
| 2016/0242610 | A1 | 9/2016 | Smith et al. |
| 2016/0287041 | A1 | 10/2016 | Conrad |
| 2017/0020351 | A1 | 1/2017 | Sjoberg |
| 2017/0079491 | A1 | 3/2017 | Dimbylow |
| 2017/0112341 | A1 | 4/2017 | Han et al. |
| 2017/0209012 | A1 | 7/2017 | Peters et al. |

FOREIGN PATENT DOCUMENTS

| | | |
|---|---|---|
| CN | 3631395 | 4/2007 |
| CN | 1313046 C | 5/2007 |
| CN | 300745058 | 2/2008 |
| CN | 301105104 S | 1/2010 |
| CN | 101657133 A | 2/2010 |
| CN | 101662975 A | 3/2010 |

(56) References Cited

FOREIGN PATENT DOCUMENTS

| | | | | | |
|---|---|---|---|---|---|
| CN | 101822508 | | | 9/2010 | |
| CN | 301394092 | S | | 11/2010 | |
| CN | 201658325 | U | | 12/2010 | |
| CN | 301418265 | S | | 12/2010 | |
| CN | 201870568 | U | | 6/2011 | |
| CN | 102217910 | A | | 10/2011 | |
| CN | 102342795 | A | | 2/2012 | |
| CN | 102475523 | | | 5/2012 | |
| CN | 302268616 | S | | 1/2013 | |
| CN | 202776160 | U | | 3/2013 | |
| CN | 203122295 | U | | 8/2013 | |
| CN | 103417161 | | | 12/2013 | |
| CN | 203354473 | U | | 12/2013 | |
| CN | 302687896 | S | | 12/2013 | |
| CN | 203539239 | U | | 4/2014 | |
| CN | 103932638 | A | | 7/2014 | |
| CN | 203802395 | U | | 9/2014 | |
| CN | 104083125 | A | | 10/2014 | |
| CN | 203852304 | U | | 10/2014 | |
| CN | 203987858 | U | | 12/2014 | |
| CN | 303181593 | S | | 4/2015 | |
| CN | 204336819 | U | | 5/2015 | |
| CN | 303198525 | S | | 5/2015 | |
| CN | 303358733 | S | | 9/2015 | |
| CN | 303423834 | S | | 10/2015 | |
| CN | 303467153 | S | | 11/2015 | |
| CN | 303521060 | S | | 12/2015 | |
| CN | 303542669 | S | | 1/2016 | |
| CN | 205107552 | U | | 3/2016 | |
| CN | 105534410 | A | | 5/2016 | |
| CN | 303662182 | S | | 5/2016 | |
| CN | 303670558 | S | | 5/2016 | |
| CN | 205286243 | U | | 6/2016 | |
| CN | 205286245 | U | | 6/2016 | |
| CN | 303702138 | S | | 6/2016 | |
| CN | 105852737 | A | | 8/2016 | |
| CN | 303842247 | S | | 9/2016 | |
| CN | 205667533 | U | | 11/2016 | |
| CN | 303903130 | S | | 11/2016 | |
| CN | 303912580 | S | | 11/2016 | |
| CN | 303989570 | S | | 12/2016 | |
| CN | 205849382 | U | | 1/2017 | |
| CN | 106361223 | A | | 2/2017 | |
| CN | 106388705 | A | | 2/2017 | |
| CN | 304045510 | S | | 2/2017 | |
| CN | 106510549 | A | | 3/2017 | |
| CN | 206138052 | U | | 5/2017 | |
| CN | 304151444 | S | | 5/2017 | |
| CN | 304211591 | S | | 7/2017 | |
| CN | 304221362 | S | | 7/2017 | |
| CN | 107049138 | A | | 8/2017 | |
| DE | 19802345 | A1 | | 5/1999 | |
| DE | 102011083449 | A1 | | 3/2013 | |
| DE | 102015106645 | A1 | | 11/2016 | |
| EM | 0003647320001 | | | 6/2005 | |
| EM | 0004233220001 | | | 12/2005 | |
| EM | 0007864470001 | | | 1/2008 | |
| EM | 0011516900001 | | | 8/2009 | |
| EM | 0013742680001 | | | 6/2013 | |
| EM | 0025331490001 | | | 10/2014 | |
| EM | 0035651750003 | | | 1/2017 | |
| EP | 1438918 | A1 | | 7/2004 | |
| EP | 1457150 | A2 | | 9/2004 | |
| EP | 1955631 | A1 | | 8/2008 | |
| EP | 2581012 | A1 | | 4/2013 | |
| EP | 2786688 | A2 | * | 10/2014 | ..... A47L 9/1633 |
| EP | 2792287 | A2 | | 10/2014 | |
| EP | 2826410 | A1 | | 1/2015 | |
| EP | 2959818 | A1 | | 12/2015 | |
| GB | 2457419 | B2 | | 8/2009 | |
| GB | 2458240 | B2 | | 9/2009 | |
| GB | 2508035 | A | | 5/2014 | |
| GB | 2526015 | A1 | | 11/2015 | |
| GB | 2542387 | A | | 3/2017 | |
| WO | 2006021489 | A1 | | 3/2006 | |
| WO | 2008070962 | A1 | | 6/2008 | |
| WO | 2008070965 | A1 | | 6/2008 | |
| WO | 2008070971 | A1 | | 6/2008 | |
| WO | 2008070973 | A1 | | 6/2008 | |
| WO | 2008070975 | A1 | | 6/2008 | |
| WO | 2009041287 | A1 | | 4/2009 | |
| WO | 2010026237 | A1 | | 3/2010 | |
| WO | 2014131104 | A1 | | 9/2014 | |
| WO | 2015043016 | A1 | | 4/2015 | |
| WO | 2017144918 | A1 | | 8/2017 | |

* cited by examiner

DIRT SEPARATION DEVICE

CROSS-REFERENCE TO RELATED APPLICATIONS

The present application is a U.S. National Phase application of PCT/GB2018/051657 filed Jun. 15, 2018, which claims priority to PCT/GB2017/051786 filed Jun. 19, 2017, PCT/GB2017/051788 filed Jun. 19, 2017, and Application No. GB 1720290.4 filed Dec. 5, 2017, the entire contents of all of which are herein incorporated by reference.

DESCRIPTION OF INVENTION

This invention relates to a dirt separation device. In particular, the invention relates to a surface cleaning apparatus including a dirt separation device.

Different kinds of surface cleaning apparatus are known. Upright cleaners are known which have an upright part pivotally connected to a floor head and a user grasps a handle of the upright part to move the floor head back and forth over a floor surface to be cleaned. Cylinder cleaners are known for which the main operative components, i.e. suction source, dirt collection chamber, are supported by a housing having wheels. A rigid elongate member fluidly connects the operative components in the housing to a floor head and the user grasps a handle of the elongate member to move the floor head along the floor surface to be cleaned whilst the housing is moved by pulling the elongate member in the desired direction. Handheld cleaners are known which have a housing supporting the operative components of the cleaner and for which the housing can be easily carried by the user during cleaning; such cleaners may or may not include a battery. Stick-vac or pole-vac cleaners are known which are formed by fluidly connecting a housing of a handheld unit to a floor head via a relatively rigid elongate member. For such cleaners, the user can steer the floor head by moving the handheld unit in the desired direction.

Surface cleaning apparatuses have a dirt separation device for separating dirt from dirt-laden air which includes the dirt lifted from the surface being cleaned through the floor head. The dirt separation device may have a separator such as a bag for separating the dirt and a dirt collection chamber in which the bag is supported as part of a so-called "bagged cleaner" for which dirt is retained in the bag as dirt-laden air is passed through the bag. The dirt separation device may have a separator in the form of a cyclonic separator which causes dirt-laden air to flow in a swirling motion around the body of the separator to cause the dirt to separate from the dirt-laden air. In such cleaners, a dirt collection chamber receives the separated dirt. The dirt collection chamber may be a part of the same body. For the surface cleaning apparatus described, it is necessary to empty the dirt collection chamber after use. In order to do this, a user typically must gain access to the dirt collection chamber by opening a cover member in the form of a lid or the like which closes an opening at an end of the dirt collection chamber. In some cases, the cover member is held closed by a latch. The latch may have a user graspable portion connected thereto and the user graspable portion is provided on an external surface of the cover member. Operating such a latch can lead to a user's hand coming into contact with some of the dirt in the dirt collection chamber as the cover member opens and the dirt falls out. In some cases, the latch is operable by a user graspable portion that is remote from the cover member. Typically, for such apparatus, there is a rod member or the like that moves in a linear motion to release the latch when the user pushes on the user graspable portion. This can be cumbersome to operate in practice because it relies on the user applying sufficient force to move the rod member effectively. Having to press on the user graspable portion to apply a force to the rod member can be unsatisfactory from an ergonomic perspective. For cases where the user graspable portion is provided on a housing supporting the dirt separator device or on the dirt separator device itself, pressing on the user graspable portion can cause the housing/dirt separation device to move unless the user applies a balancing force on the housing/dirt separation device to stop such movement.

There are manufacturing and design disadvantages with known arrangements such as unreliable operation, having to manufacture separate multiple components, and having to manufacture relatively costly parts (e.g. metal rods and the like).

An issue with known arrangements of dirt separation devices which utilise a cyclonic separator is that dirt can become lodged within parts of the cyclonic separator and/or a dirt collection chamber. The dirt can become compressed during operation such that the user must manually agitate the dirt to remove it, i.e. such dirt does not fall out of the dirt separation device under gravity unless the user has loosened the dirt first.

The present invention seeks to ameliorate one or more of the above described problems and/or provide an alternative solution.

According to an aspect of the present invention we provide a dirt separation device for a surface cleaning apparatus including:

- a separator for separating dirt from dirt-laden air;
- an inlet through which dirt-laden air is drawn into the separator;
- an outlet through which cleaner air exits the separator;
- a dirt collection chamber for receiving separated dirt;
- a cover member moveable between a first position in which the cover member inhibits access to the dirt collection chamber and a second position in which the cover member permits access to the dirt collection chamber;
- an actuator device coupled to the cover member for effecting movement of the cover member from the first position to the second position
- wherein the actuator device is rotationally moveable, or an engagement part operably connected to the actuator device is rotationally moveable, to effect movement of the closing member from the first position to the second position.

According to an aspect of the present invention we provide a dirt separation device for a surface cleaning apparatus including:

- a separator for separating dirt from dirt-laden air;
- an inlet through which dirt-laden air is drawn into the separator;
- an outlet through which cleaner air exits the separator;
- a dirt collection chamber for receiving separated dirt;
- a cover member moveable between a first position in which the cover member inhibits access to the dirt collection chamber and a second position in which the cover member permits access to the dirt collection chamber;
- an actuator device coupled to the cover member for effecting movement of the cover member from the first position to the second position;
- an engagement part operably connected to the actuator device;

wherein, when operated, the engagement part moves along an arcuate path to effect movement of the closing member from the first position to the second position.

Optionally the dirt separation device has an elongate axis A and the actuator device or the engagement part is rotationally moveable about the elongate axis A.

Optionally the engagement part is positioned within the dirt collection chamber.

Optionally the engagement part is engagable with the cover member to retain the cover member in its first position.

Optionally the cover member includes a co-operating member for co-operating with the engagement part.

Optionally the co-operating member is positioned on an interior surface of the cover member that defines a portion of the dirt collection chamber.

Optionally the dirt separation device includes opposing first and second ends, and wherein the first end includes the actuator device and the second end includes the cover member.

Optionally the actuator device closes an opening at the first end of the dirt separation device.

Optionally the actuator device defines a portion of an air flow passage upstream of the separator.

Optionally the actuator device includes a user graspable portion.

Optionally the actuator device is connected to a part of the separator such that rotation of the actuator device causes rotation of a part of the separator.

Optionally the actuator device and the part of the separator are connected by a steadfast connection to prevent relative movement therebetween.

Optionally the separator is a cyclonic separator and the part of the separator is a shroud thereof.

Optionally the separator is a cyclonic separator and the part of the separator is a dirt collection chamber thereof.

Optionally the separator is a cyclonic separator device including:

a first separating chamber fluidly connected to the inlet for separating relatively coarse dust or debris from the dirt-laden air;

an inlet through which dirt-laden air is drawn into the first dirt separating chamber;

a first dirt collection chamber for receiving dirt separated by the first separating chamber;

an outlet through which cleaner air exits the first separating chamber;

a shroud;

a second separating chamber for separating relatively fine dirt from the dirt-laden air cleaned by the first separating chamber, a second dirt collection chamber in communication with the second separating chamber;

an outlet through which cleaner air exits the second separating chamber;

an inlet through which cleaned dirt-laden air exiting the first separating chamber is drawn into the second separating chamber.

Optionally the actuator device is connected to the shroud such that rotation of the actuator device causes rotation of the shroud.

Optionally the engagement part is connected to or forms a part of the second dirt collection chamber.

Optionally the second dirt collection chamber has a wall defining a space in which the relatively fine dirt is collected and the engagement part is connected to or forms a part of the wall.

Optionally the actuator device is connected to the second dirt collection chamber such that rotation of the actuator device causes rotation of the second dirt collection chamber.

Optionally the actuator device is connected to the second dirt collection chamber through the second separating chamber.

Optionally the second separating chamber is positioned generally within the shroud, and the second separating chamber includes:

a generally frusto-conical portion with a central axis and the generally frusto-conical portion has an end part in communication with the second dirt collection chamber through which fine dirt exits therethrough into the second dirt collection chamber, and wherein the inlet of the second separating chamber is configured to direct the incoming said cleaned dirt-laden air such that it travels circumferentially around an inner surface of the generally frusto-conical portion, and wherein the second dirt collection chamber is connected to the second separating chamber in a steadfast manner to prevent relative movement therebetween.

According to an aspect of the present invention we provide a surface cleaning apparatus including a housing supporting:

a suction source;

a dirt separation device according to any preceding aspect/optional aspect, wherein the dirt separation device has an elongate axis (A);

a user graspable handle having an elongate axis (C), a passage member for transporting dirt-laden air to the dirt separation device, the passage member having an elongate axis (B);

wherein the elongate axis (B) of the passage member and the elongate axis (C) of the user graspable handle lie in a plane (P1), and the elongate axis (A) of the dirt collection chamber intersects the plane (P1).

According to an aspect of the present invention we provide a surface cleaning apparatus including:

a housing supporting:

a suction source;

a dirt separation device according to any preceding aspect/optional aspect, wherein the dirt separation device has an elongate axis (A) and wherein, in normal use, the housing is supported on a floor surface and the elongate axis (A) of the dirt separation device is parallel with the floor surface.

Optionally the apparatus includes:

a surface cleaning tool;

an elongate member having an elongate axis, said elongate member connecting the surface cleaning tool to the housing and including a passage for carrying dirt-laden air from the surface cleaning tool to the dirt collection chamber.

Optionally the apparatus is a handheld cleaner.

Optionally the apparatus is a cylinder cleaner.

Embodiments of the invention will be set out below by way of example only with reference to the accompanying figures, of which:

Figure 5:
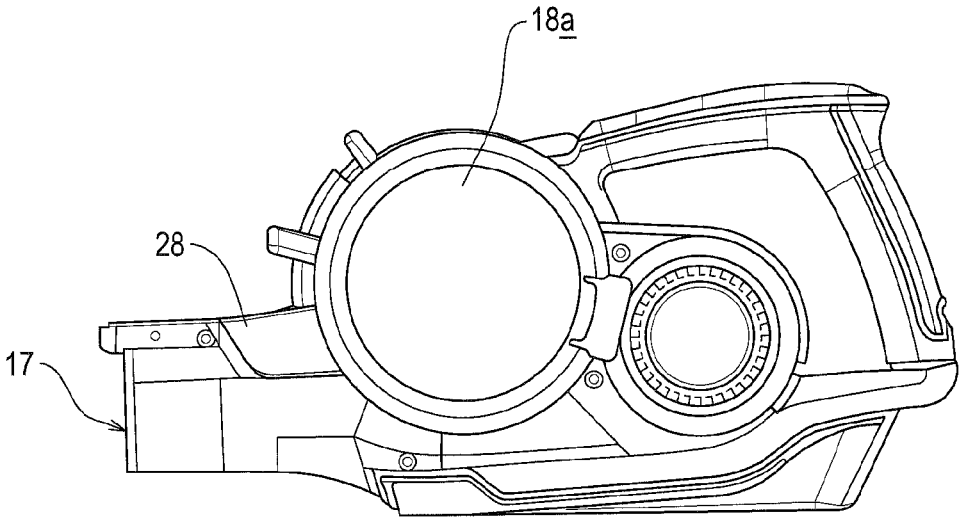
FIG. 5 is a side view of a housing of the apparatus of FIG. 1, which housing is operable as a handheld surface cleaning apparatus.
Figure 6:
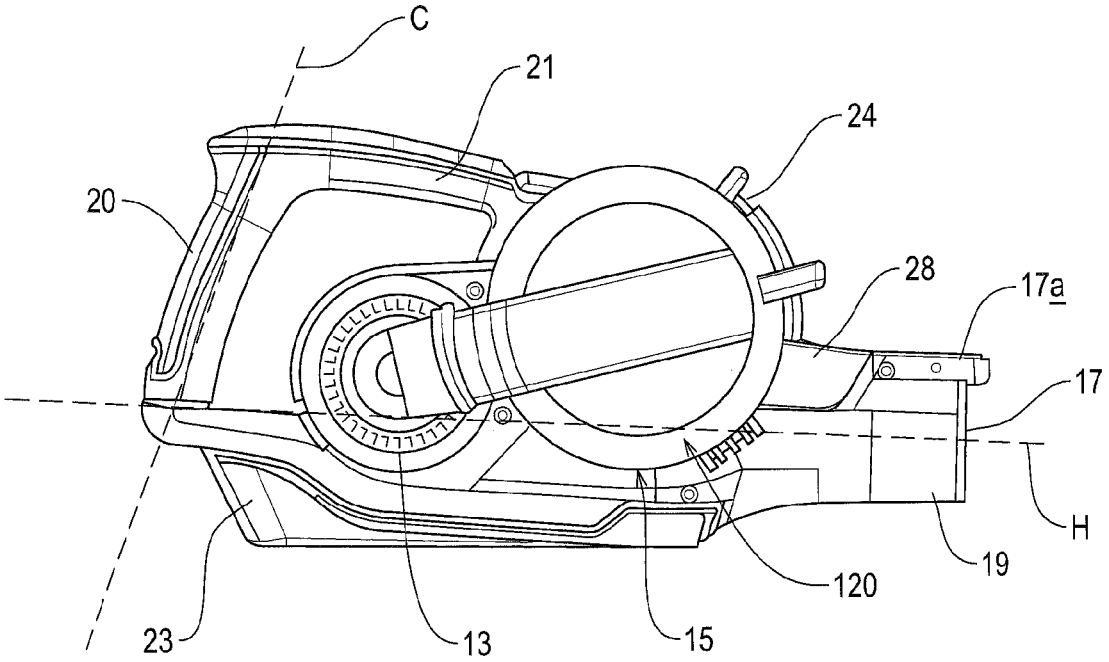
FIG. 6 is an opposite side view of the housing of FIG. 5.
Figure 7A:
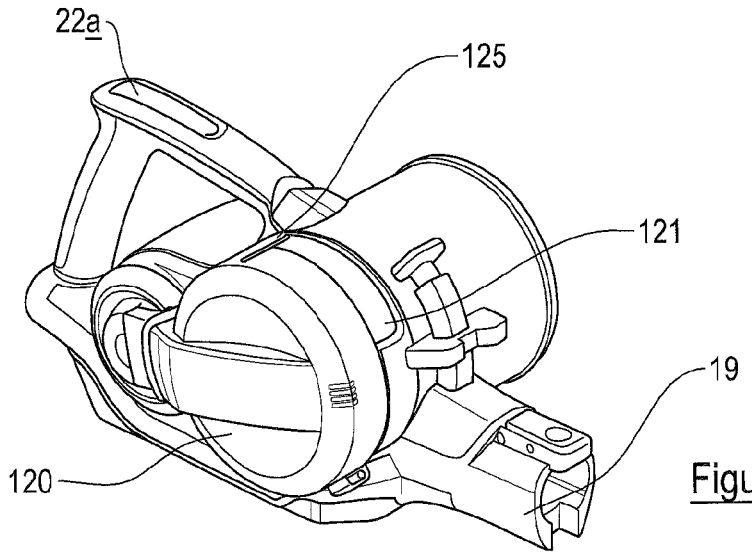
Figure 7B:
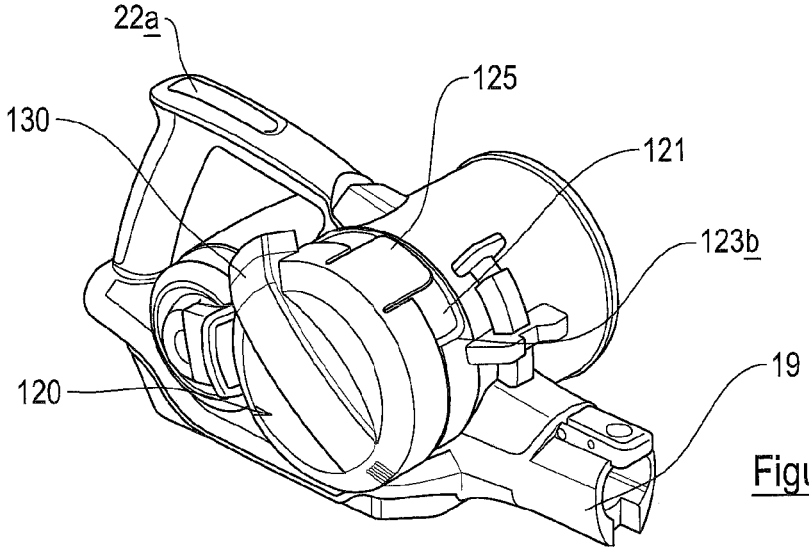
Figure 7C:
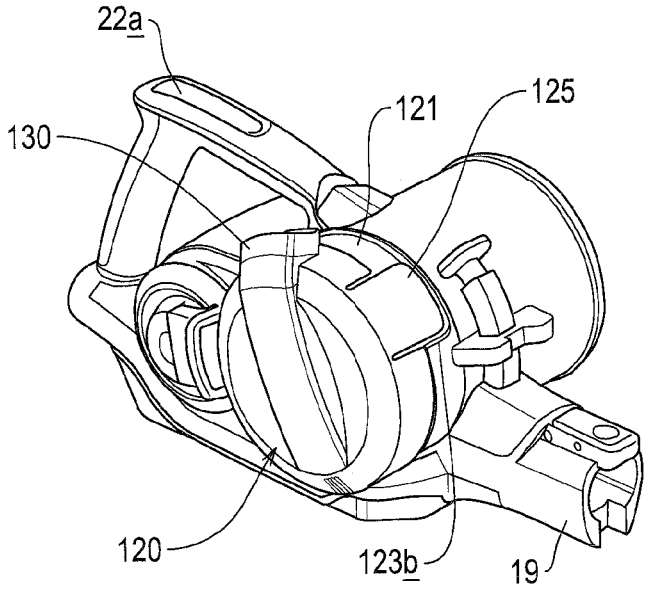
Figure 8:
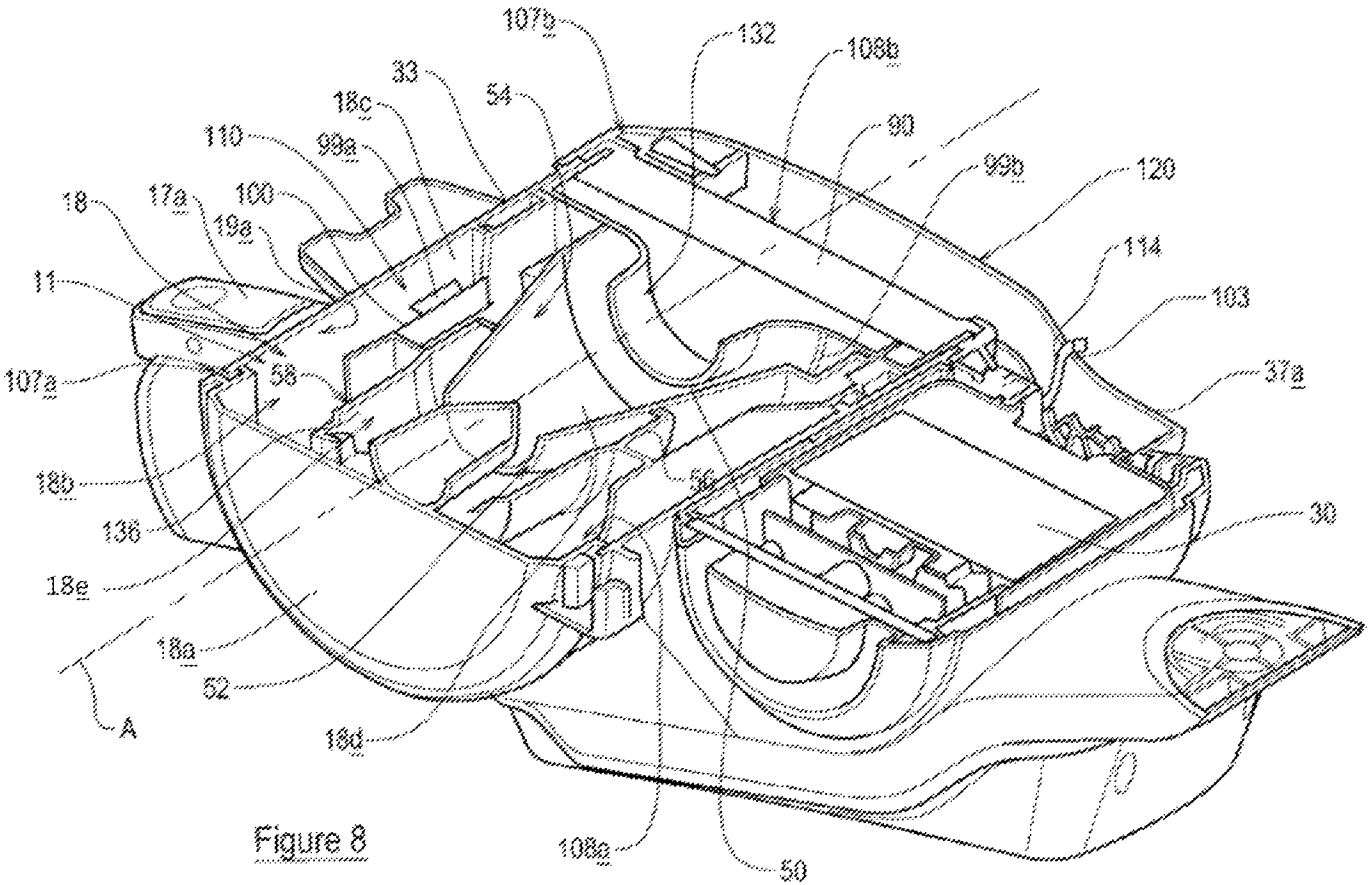
Figure 9:
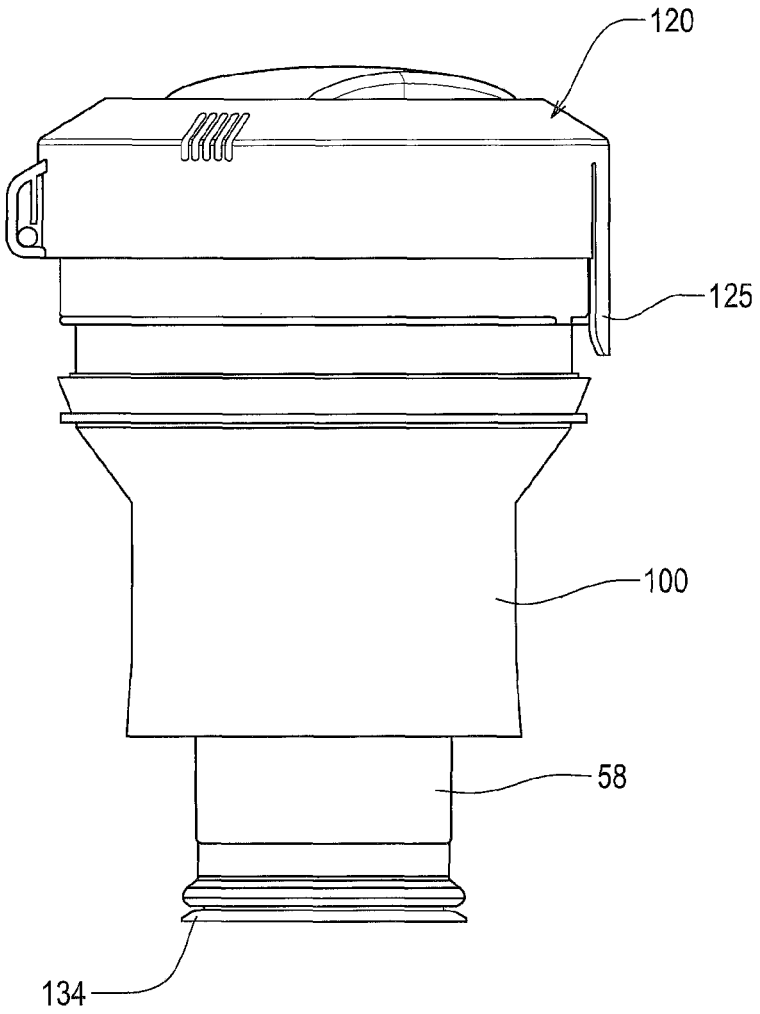
Figure 10:
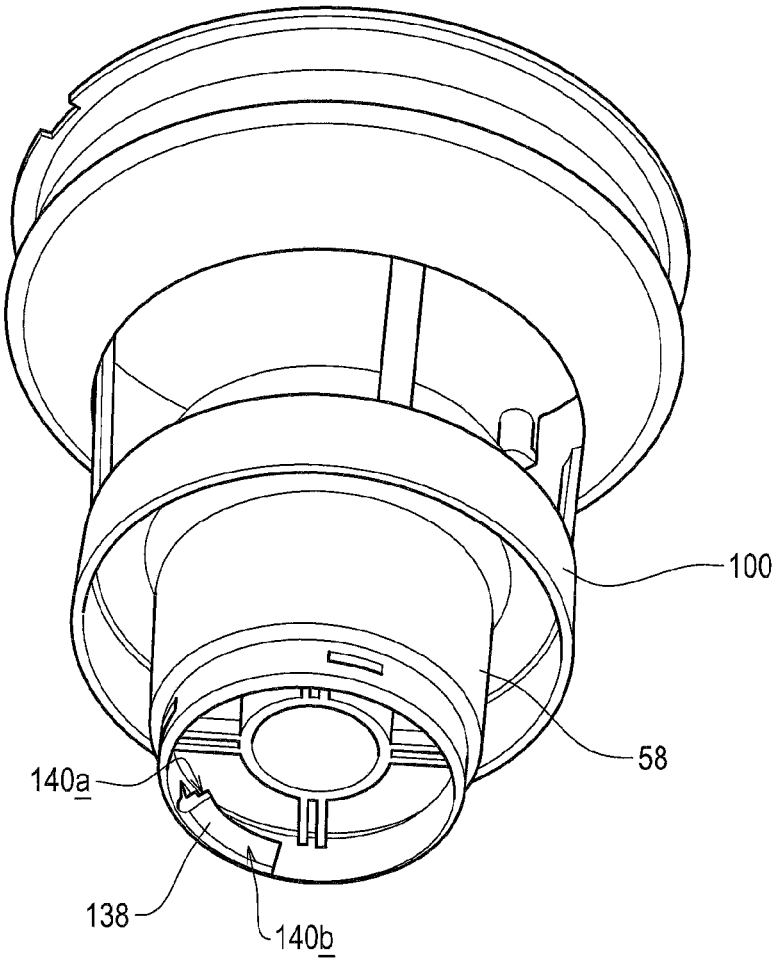
Figure 11:
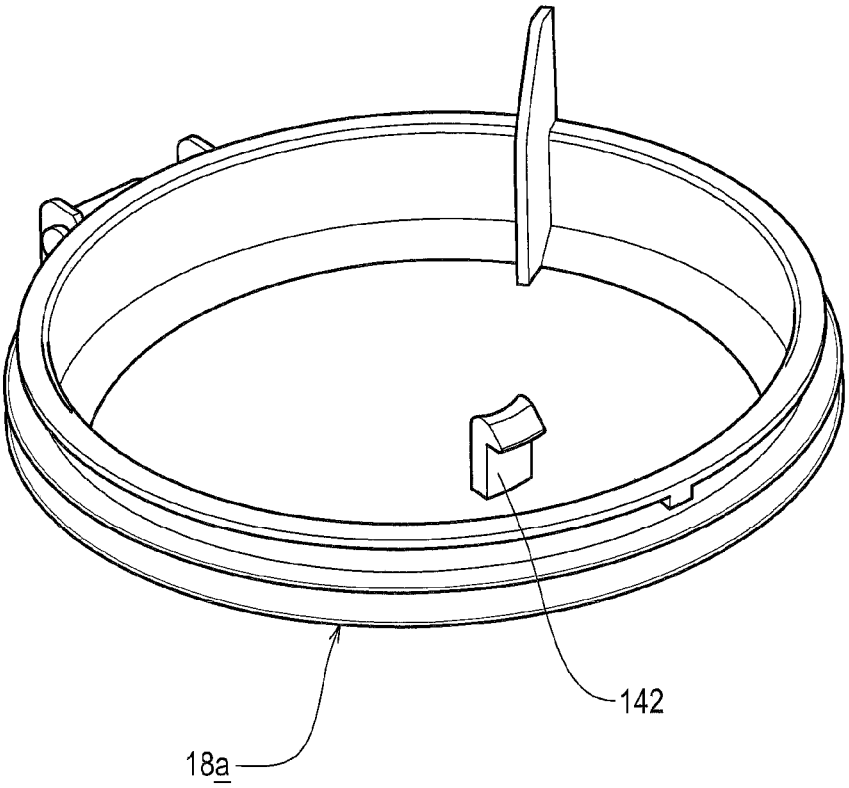
Figure 12A:
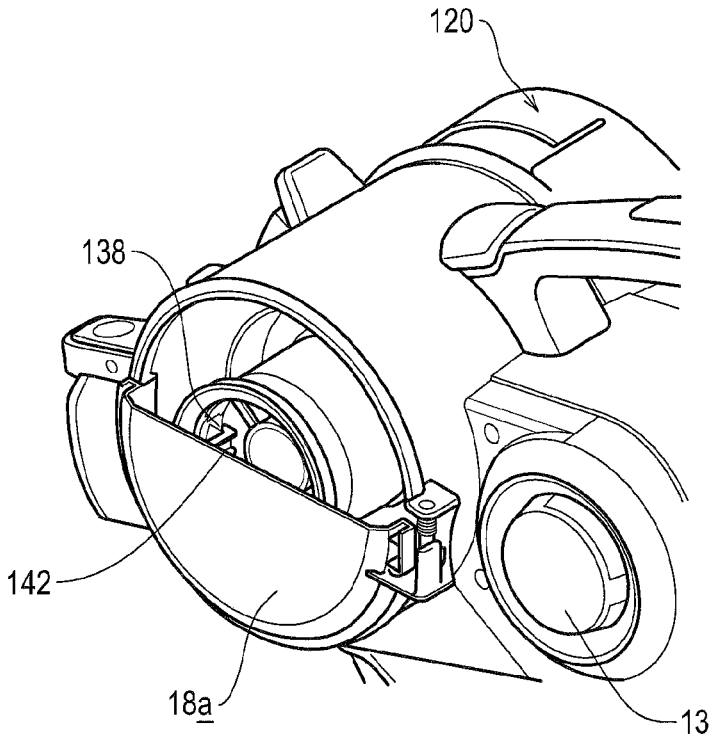
Figure 12B:
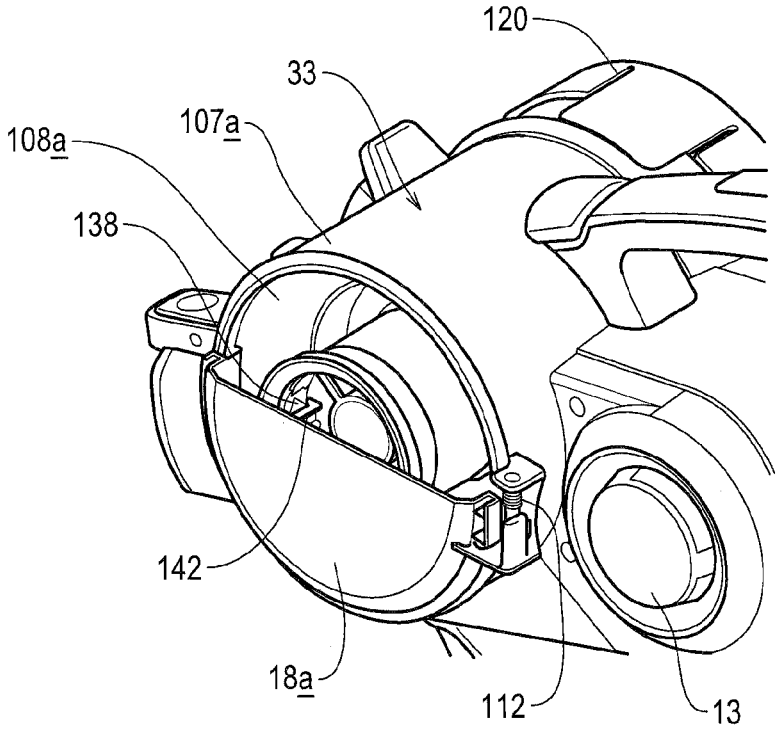
Figure 12C:
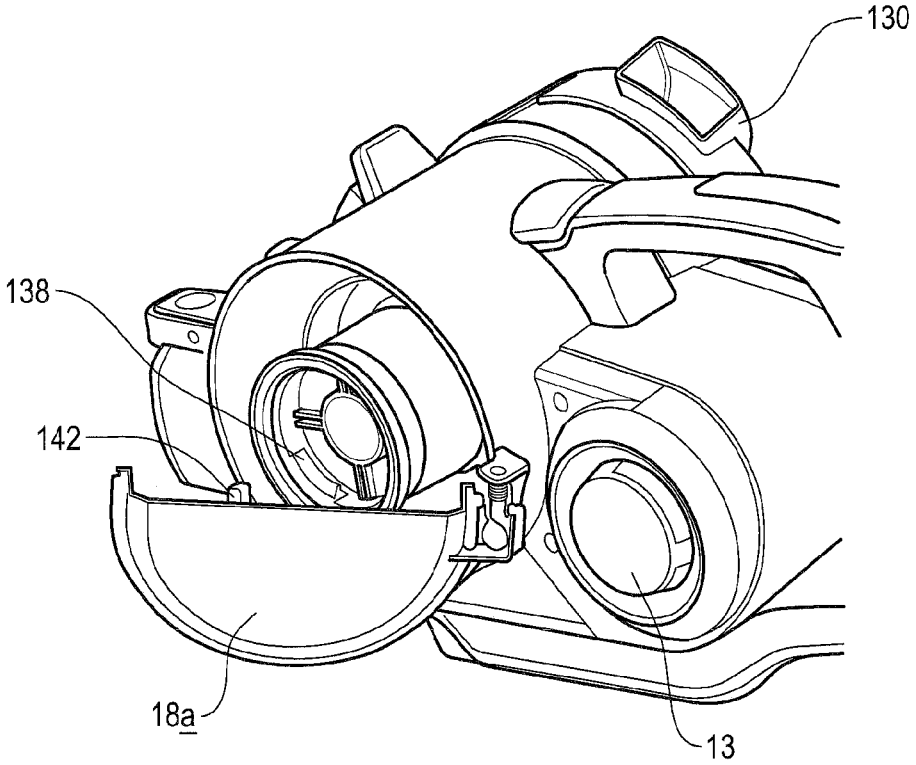
Figure 13:
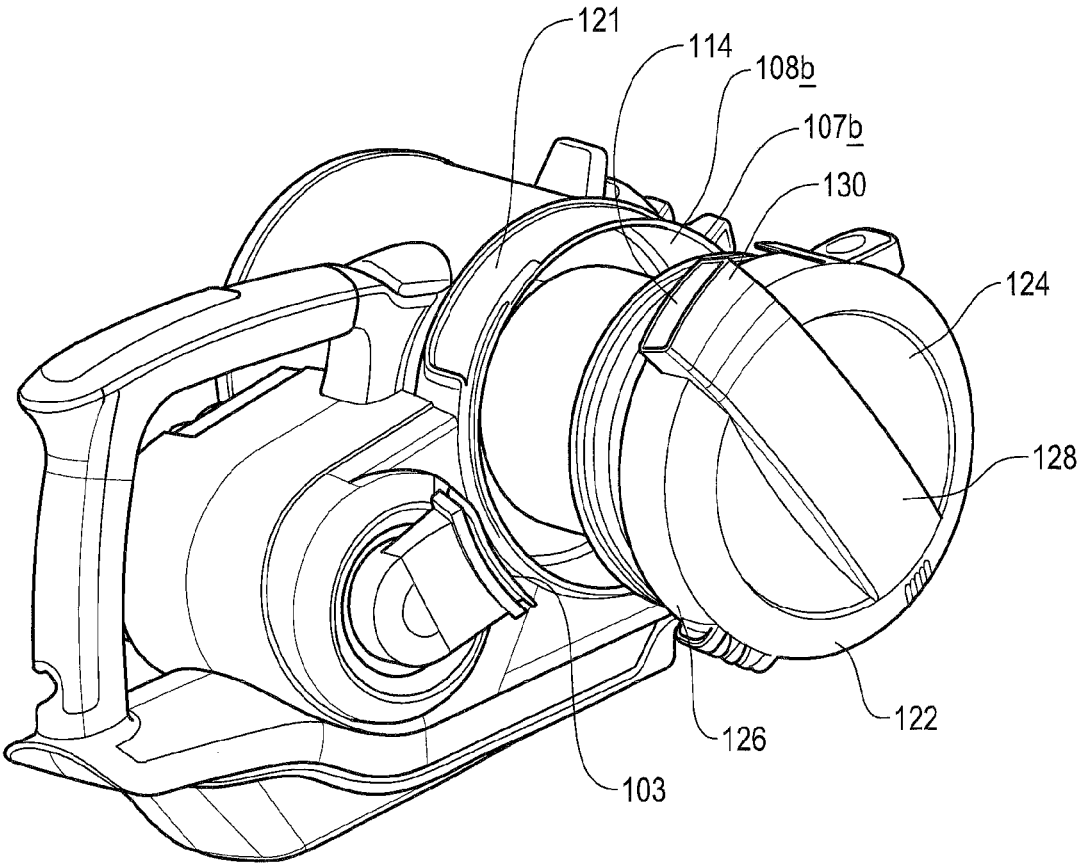

FIGS. 7*a* to 7*c* are perspective views of the housing of FIG. 5 in different states of operation;

FIG. 8 is a cross-section view of the housing of FIG. 5;

FIG. 9 is a side view of certain component parts of the housing of FIG. 5;

FIG. 10 is a perspective view of the component parts shown in FIG. 9;

FIG. 11 is a perspective view of a component part of the housing of FIG. 5;

FIGS. 12*a* to 12*c* are partial cross-sectional views of the housing of FIG. 5 in different states of operation; and FIG. 13 is a perspective view of the housing of FIG. 5 showing the side of the housing shown in FIG. 6 in a certain state of operation.

Referring to the figures, these show a surface cleaning apparatus 10 in accordance with the present invention. The apparatus 10 includes a surface cleaning tool 12 (a floor head in this example), a housing 16 having an elongate axis H and an elongate member 14, having an elongate axis E, connecting the surface cleaning tool 12 to the housing 16. The elongate member 14 is relatively rigid. The housing 16, in this example, is operable as a handheld surface cleaning apparatus, commonly known as a hand vac, when the elongate member 14 is not connected thereto, and in this state the housing 16 can be used with or without the surface cleaning tool 12 connected thereto. The housing 16 supports a suction source 13, a dirt separation device 15 including a dirt collection chamber 18 and a separator 11 which, in this embodiment, is a cyclonic separator. The dirt separation device 15 is generally cylindrical. Dirt separation device 15 also includes a filter 90 for cleaning the relatively clean air outputted by the separator 11. The dirt separation device 15 has an elongate axis A. The suction source 13 and dirt separation device 15 are spaced apart along axis H of the housing 16. The dirt separation device 15 is positioned forwardly of the source of suction 13. In embodiments, the suction source 13 is an electric motor driving a rotatable fan, but any appropriate suction source may be used. All that is necessary is for the suction source to be able to draw air through the surface cleaning tool 12 and elongate member 14 towards the dirt collection chamber 18.

The dirt separation device 15 may be detached from the housing 16. The dirt separation device 15 is pivotally connected to the housing 16. The surface cleaning apparatus 10 includes an actuator member 24 for effecting release of the dirt separation device 15.

In embodiments, the housing 16 supports or contains a battery 23 to provide electrical power to the suction motor and other components of the apparatus 10. The battery 23 is of a generally elongate shape but may be of a different shape in other embodiments.

In embodiments, the housing 16 includes a passage member 19 for fluid communication with an inlet of the dirt separation device 15. The passage member 19 is generally elongate. The passage member 19 has an elongate axis B. A first end of the passage member 19 defines an inlet 17 for receiving dirt-laden air. The first end is connectable to the elongate member 14 or surface cleaning tool 12. When connected, axis B is co-axial with the elongate axis E of the elongate member 14. In embodiments, axis B may not be co-axial and be parallel to the elongate axis E and/or offset from the elongate axis E.

In embodiments, the dirt separation device 15 includes an inlet passage member 28 for fluid communication with the passage member 19. The inlet passage member 28 is generally elongate. The inlet passage member 28 defines a passage which fluidly connects the passage member 19 to the dirt separation device 15.

Whilst in the present embodiment the dirt separation device 15 includes a separator 11 in the form of a cyclonic separator, embodiments are envisaged where the separator 11 may be a bag which is supported in a dirt collection chamber of the dirt separation device 15. The bag may collect dirt by filtering the dirt-laden air. In embodiments, the separator 11 may be any other appropriate device to separate the dirt from the air, for example, an upstream filter that separates dirt from the dirt-laden air to cause it to collect in a dirt collection chamber of the dirt separation device 15. The dirt separation device 15 includes a pivotally movable cover member 18*a* in the form of a cover or lid which enables a user to access the dirt collection chamber 18 to empty dirt collected therein, or for embodiments using a bag, to remove the bag therein.

The dirt separation device 15 includes a wall 33 having first 107*a* and second 107*b* opposing ends with respective openings 108*b*, 108*a*. The ends 107*b*, 107*a* are also opposing ends of the device 15. An internal surface of the wall 33 defines a space 110 in which certain component parts of the separator 11 are positioned and which space 110 forms a portion of the dirt collection chamber 18.

Opening 108*a* is in communication with the dirt collection chamber 18 and cover member 18*a* is for closing the opening 108*a*. Cover member 18*a* is pivotally connected to the second end 107*a*. The cover member 18*a* is connected to the first end 107*a* of wall 33 by a hinge. Cover member 18*a* is moveable between a first position in which it closes the dirt collection chamber 18 and a second position in which the cover member 18*a* permits access to the dirt collection chamber 18.

The dirt separator device 15 includes a biasing member 112 for biasing the cover member 18*a* to its first position in which it is open, i.e. the biasing member urges the cover member to pivot outwardly away from the first end 107*a* so that the dirt collection chamber 18 is accessible. In embodiments, the biasing member 112 is a spring which is fixed relative to the first end 107*a* at one end and fixed to the cover member 18*a* at an opposite end.

The elongate member 14 includes a passage for carrying dirt-laden air from the surface cleaning tool 12 to the dirt separation device. In this example the surface cleaning tool 12 includes a motor for driving a rotatable floor agitating member or brush, so the elongate member 14 includes a further passage through which electrical cables may extend to provide an electric connection between the housing 16 and the motor in the surface cleaning tool 12.

The surface cleaning tool 12 is disconnectable from the elongate member 14, so that, for example, another tool can be connected to the free end of the elongate member 14. The elongate member 14 is also disconnectable from the housing 16, by way of a manually operated switch 17*a*. This enables the housing 16 to be used as handheld surface cleaning apparatus, with the option of being able to connect another tool to the location from where the elongate member 14 is removed.

The housing 16 includes a handle for holding the apparatus 10, said handle including first 20 and second 21 user-graspable portions which are connected to each other substantially at right-angles. The dirt separation device 15 is positioned forwardly of the handle. A first end of the first user-graspable portion 20 is connected to the housing 16 and the portion 20 extends generally upwardly and away therefrom. User-graspable portion 20 has an elongate axis C. A first end of the second user-graspable portion 21 is connected to the housing 16 and extends generally rearwardly away therefrom and from the elongate member 14. Respective second ends of the first 20 and second 21 user-graspable portions are connected to each other. Essentially, the first 20 and second 21 user-graspable portions form a handle which is L-shaped and which provides two locations each of which is sized such that it can be grasped fully by a hand of a user. A device 22*a*, e.g. a switch, for turning the apparatus "on" is positioned at the connection of the second ends of the first 20 and second 21 user-graspable portions to each other.

The suction source 13 is in the form of an electric motor 30 with an axle which is connected at one end to a fan. The motor 30 may be any appropriate motor, e.g. DC, AC, brushless.

The suction source 13 is positioned such that its axle extends transversely to the elongate axis H of the housing 16. The axes of the axle and axis A of the dirt separator device 15 extend perpendicularly to the elongate axis H of the housing 16. The axes of the axle and dirt collection chamber 18 are also parallel to one another in this embodiment but they may not be in other embodiments.

In embodiments, the dirt separation device 15 has an elongate axis A which is coaxial with an elongate axis of the dirt collection chamber 18. In embodiments, the elongate axes of the dirt separation device 15 and dirt collection chamber 18 may not be coaxial. In embodiments, the separator 11 has an elongate axis which is coaxial with one or more or all of the elongate axes of the dirt separation device 15 and the dirt collection chamber 18. In embodiments having a cyclonic separator, the elongate axis thereof corresponds to an axis about which dirt-laden air is caused to rotate by the cyclonic separator as it passes through the apparatus 10.

Figure 1:
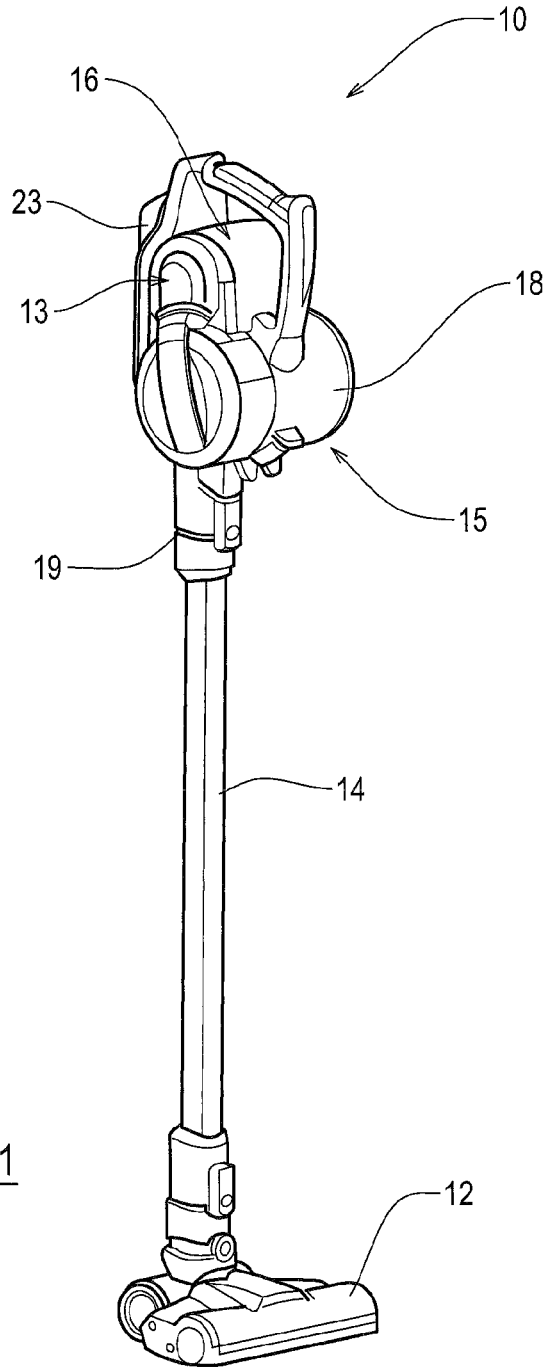
FIG. 1 is a perspective view of a surface cleaning apparatus.
Figure 2:
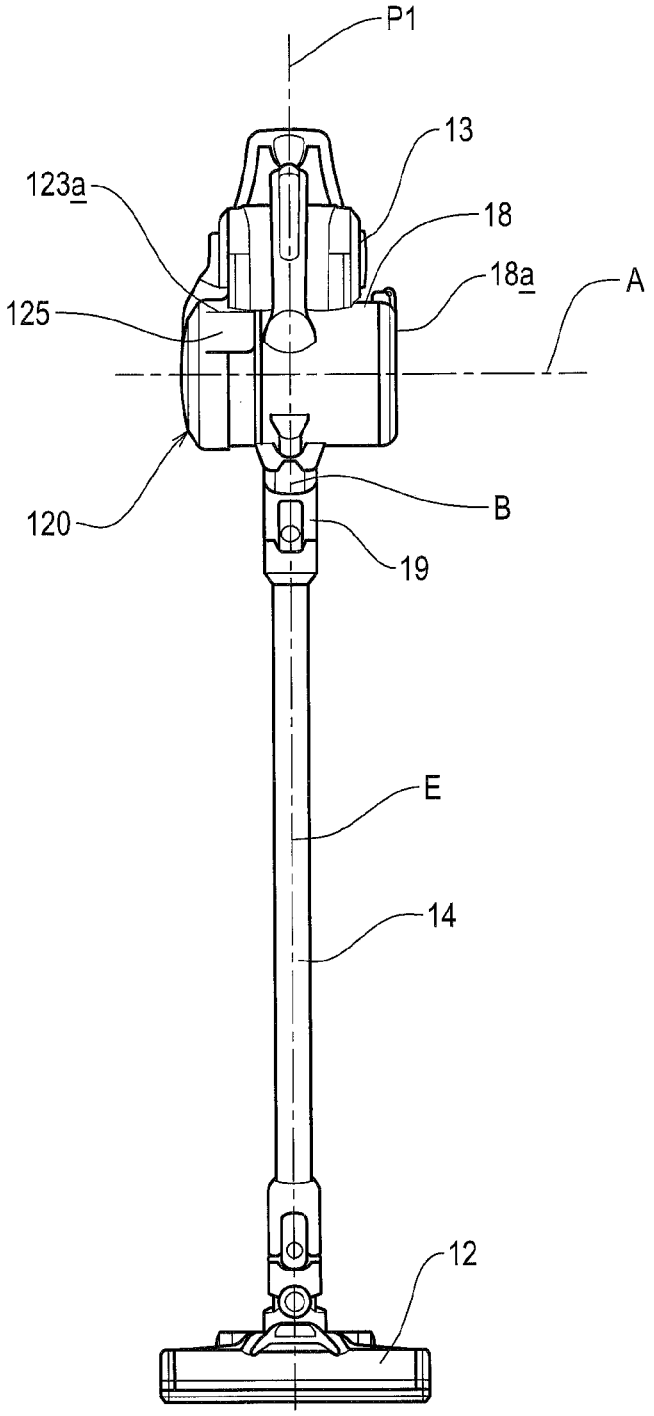
FIG. 2 is a front view of the apparatus of FIG. 1.
Figure 3:
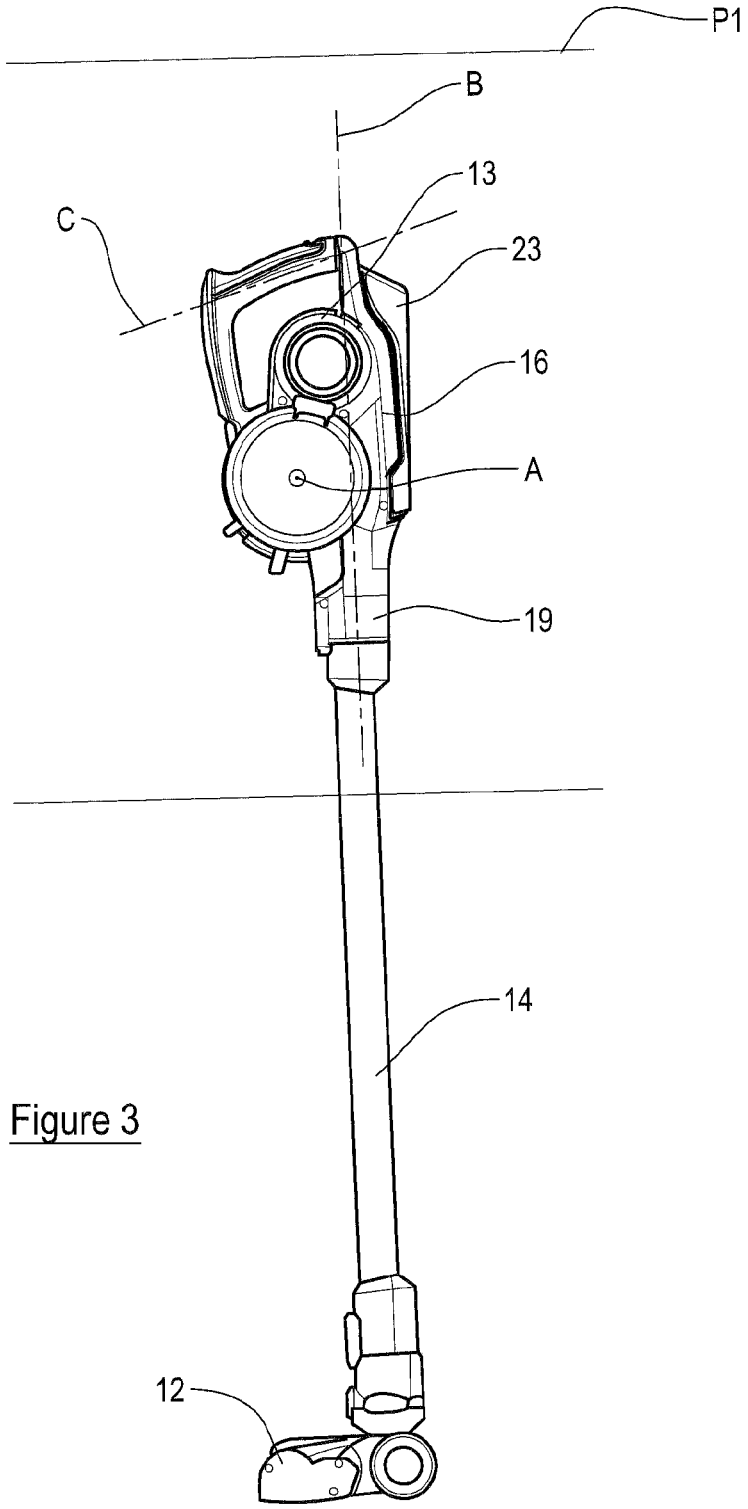
FIG. 3 is a side view of the apparatus of FIG. 1.
Figure 4:
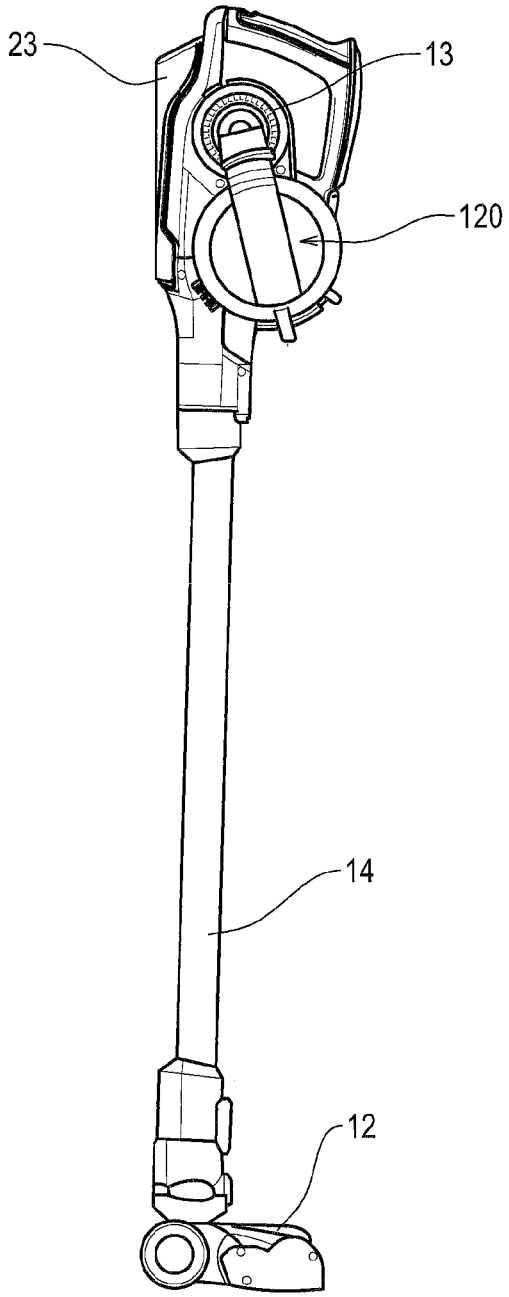
FIG. 4 is an opposite side view of the apparatus of FIG. 1.

In embodiments, including those shown in the figures, the elongate axis B of the passage member 19 and the elongate axis C of the first user graspable portion 20 of the handle lie in a plane P1, and the elongate axis A of the dirt separation device 15 intersects the plane P1 (as shown in FIGS. 2 and 3). In embodiments, the elongate axis A is substantially horizontal in normal use.

The dirt separation device 15 includes an actuator device 120 coupled to the cover member 18*a* for effecting movement of the cover member 18*a* from its first position to the second position. In embodiments, the actuator device 120 is positioned at the second end of the dirt separation device 15. The actuator device 120 may include a lid 122 which closes the second end 107*b* of the dirt separation device 15. The actuator device 120 is pivotally connected to the second end of the dirt separation device 15. In embodiments, the actuator 120 is pivotally connected to the wall 33. The lid 122 has an end face 124 which is generally circular in plan view and has a wall 126 extending around the perimeter of the end face 124. The wall 33 includes a channel 121 extending circumferentially about its outer surface near the end 107*b*. The channel 121 is a recess defined by the wall 33 and has an open face at the free end of end 107*b*. The channel 121 has first and second ends 123*a*, 123*b*. The wall 126 includes an elongate abutment member 125 that extends away therefrom. The abutment member 125 sits in the channel 121 when the lid 122 is attached to the wall 33 and is slidably moveable therein when the actuator device 120 is rotated.

The actuator device 120 is rotationally connected to the wall 33. The actuator device 120 may rotate about the axis A. The actuator device 120 may rotate between a first position in which the actuator device 120 cannot be released from the wall 33 and a second position in which the actuator device 120 can be released from the wall 33. The connection between the actuator device 120 and wall 33 may be in the form of a bayonet fitting or any other type of threaded connection that permits the aforementioned functionality.

In embodiments, the actuator device 120 includes a user graspable portion 128 on its external surface. In embodiments, including those shown in the figures, the user graspable portion 128 is provided on the end face 124. The user graspable portion 128 includes a raised elongate formation that extends diametrically across the end face 124 and has opposing side walls that can be gripped by a user. In embodiments, including those shown in the figures, the user graspable portion 128 also defines a part of an upstream air flow passage from the separator 11. The user graspable portion 128 terminates in a free end portion 130 which sits proud of the wall 126.

In embodiments, the free end portion 130 includes a passage having an end face which defines an outlet 114 to fluidly connect an outlet 114 of the dirt separation device to an inlet 103 of the suction source 13. In more detail, an inlet passage 37*a* to the suction source 13 has an end face which defines an inlet 103. The end face of the inlet passage 37*a* includes a seal extending around its perimeter which abuts in a sealing manner with an end face of the outlet 114 when the dirt separation device 15 is attached to the housing 16. When the dirt separation device 15 is pivoted or the actuator device 120 is rotated, the respective end faces slide past one another.

In embodiments, the separator 11 is a cyclonic separator which has first and second dirt collection chambers 18*b*, 18*e* provided at end 107*a* thereof.

With reference to FIG. 8, the separator 11 has first and second separating chambers 18*c*, 18*d* adjacent the first and second dirt collection chambers 18*b*, 18*e*. By referring to chambers 18*c*, 18*d*, 18*b*, 18*e*, it should be understood that the chambers include walls provided by various components and that those walls define respective one or more surfaces and spaces of the chambers.

The separator 11 includes a shroud 100 which also has an elongate axis coaxial with the axis A, the axis A being that about which dirt-laden air is caused to rotate as it passes through the apparatus 10 and circulates around the shroud 100. Shroud 100 is positioned at a part of the separator 11 at end 107*b* thereof which is opposite to the end 107*a* at which the first and second dirt collection chambers 18*b*, 18*e* are provided. The shroud 100 has a generally cylindrical portion having openings therein for the passage of air positioned generally centrally of the separator 11.

The first separating chamber 18*c* is for separating relatively coarse dust or debris from the dirt-laden air. The first separating chamber 18*c* is in communication with the first dirt collection chamber 18*b* so that separated dust or debris falls into the first dirt collection chamber 18*b* therefrom.

The second separating chamber 18*d* is positioned generally within the shroud 100 and is for separating relatively fine dust or debris from the dirt-laden air cleaned by the first separating chamber 18*c*. The second separating chamber 18*d* is in communication with the second dirt collection chamber 18*e* so that separated dust or debris falls into the second dirt collection chamber 18*e* therefrom.

The separator 11 includes an inlet 99*a* through which dirt-laden air is drawn into the first separating chamber 18*c*. The inlet 99*a* is configured to direct the incoming dirt-laden air into a generally cylindrical portion of the first separating chamber 18*c* such that it travels circumferentially around an inner surface 19*a* of the first separating chamber 18*c*. Whilst in this embodiment the elongate axes of the dirt collection chambers 18*b*, 18*e* and the shroud 100 are coaxial or substantially coaxial, they need not be. They could, for example, be parallel and offset from each other or inclined relative to each other. Alternatively, the shroud 100 could be positioned generally centrally of the generally cylindrical portion of one or both of the separating chambers 18*c*, 18*d*.

The separator 100 includes an inlet 99*b* through which cleaned dirt-laden air exiting the first separating chamber 18*c* is drawn into the second separating chamber 18*d*. The second separating chamber 18*d* includes a generally frusto-conical portion 50 with a central axis. The frusto-conical portion 50 has an end part 52 in communication with the second dirt collection chamber 18*e* through which fine dust or debris exits therethrough into the second dirt collection chamber 18*e*.

The inlet 99*b* of the second separating chamber 18*d* is configured to direct the incoming cleaned dirt-laden air such that it travels circumferentially around an inner surface 54 of the generally frusto-conical portion 50. The use of such a frusto-conical portion 50 may permit the second separating chamber 18*d* to separate finer dust or debris from the air than that achievable by the first separating chamber 18*c*.

The second separating chamber 18*d* includes an outlet 132 through which relatively clean air may leave the chamber 18*d*. A filter 90 is supported above the outlet 132 through which the relatively clean air may pass. The relatively clean air then flows upstream along an air flow path towards the inlet 103 of the suction source 13. The air flow path is partly defined by an internal surface of the actuator device 120. The internal surface may be part of the lid 122.

The second dirt collection chamber 18*e* includes a first portion 56 positioned near the end part 52 of the generally frusto-conical portion 50 and a second portion 58 connected to the first portion 56 which extends to the cover member 18*a*. The second portion 58 may include a seal 134 provided at its free end for sealing against the cover member 18*a*.

The first and second portions 56, 58 are generally cylindrical with the first portion 56 having a greater cross-sectional area than the second portion 58, i.e. as considered without the portion 50 being positioned therein. In more detail the second portion 58 includes a wall 136 defining an internal space in which the fine dirt or debris is collected during use. A free end of the wall 136 which is adjacent the cover member 18*a* includes an engagement part 138 extending into the internal space. In embodiments, including those shown in the figures, the engagement part 138 is an integral part of the second dirt collection chamber 18*e* but it may not be in other embodiments. The engagement part 138 is in the form of a ledge that extends circumferentially around a portion of the free end. In side cross-section, the engagement part 138 is generally wedge-shaped. The engagement part 138 has opposing first 140*a* and second 140*b* surfaces. The first surface 140*a* faces generally upwardly into the internal space and is generally flat. The second surface 140*b* is inclined and faces generally outwardly away from the internal space.

With reference to FIG. 8, the cover 18*a* defines an inwardly facing end wall of the first dirt collection chamber 18*c* and the second dirt collection chamber 18*e*. The cover 18*a* includes a co-operating member 142 for co-operating with the engagement part 138. The co-operating member 142 is in the form of an upwardly extending rib formed on an inwardly facing wall of the cover member 18*a*. The free end of the co-operating member 142 is hook-shaped and extends radially outwardly towards the internal surface of the second dirt collection chamber 18*e*. The co-operating member 142 is positioned on the cover member 18*a* so that its free end is adjacent the engagement part 138 so that it may engage therewith. When the co-operating member 142 co-operates with the engagement part 138, the co-operating member 142 abuts the first surface 140*a* of the engagement part 138 such that it cannot move therepast. In other words, when the co-operating member 142 and engagement part 138 are in engagement, the cover member 18*a* is held in its first position. The engagement part 138 has a greater circumferential length than that of the co-operating member 142. The engagement part 138 extends arcuately about 90 degrees about elongate axis A.

The actuator device 120, second separating chamber 18*d*, shroud 100, and second dirt collection chamber 18*e* are connected to each other so that they form a single unit. Thus, rotation of the actuator device 120 causes the second separating chamber 18*d*, shroud 100 and second dirt collection chamber 18*e* to rotate therewith. The engagement part 138 is thus connected to the actuator device 120 indirectly. In embodiments, the engagement part 138 may be directly connected to the actuator device 120. The engagement part 138 is rotatable about elongate axis A when the actuator device 120 is rotated.

A user operates the surface cleaning apparatus 10 in a known manner to clean a surface. The user may empty the dirt collection chamber 18 into a waste container after dirt has collected therein. To do so the user may take the surface cleaning apparatus 10 to a waste container and place the end of the dirt separation device 15 including the cover member 18*a* over the waste container. The user may then open the cover member 18*a* and tip the dirt separation device 15 towards the container to cause the dirt contained in the dirt collection chamber to fall into the waste container. Alternatively, the user may release the dirt separation device 15 from the housing 16 and only take the dirt separation device 15 to empty the dirt collection chamber 18.

In its first closed position, the cover member 18*a* is held closed by the engagement between the engagement part 138 and the co-operating member 142. In order to open the cover member 18*a*, the user must rotate the actuator device 120 so as to release this engagement. The user may do this by grasping the user graspable portion 128 of the actuator device 120 and rotate the actuator device 120 in a clockwise direction. As the engagement part 138 is connected to the actuator device 120 through the second separating chamber 18*b* and the shroud 100, the engagement part 138 will rotate in a corresponding way. The respective parts of the actuator device 120 rotate to open the cover member 18*a* as shown in FIGS. 7*a* to 7*c*. The respective positions of the engagement part 138 at different stages of rotation of the actuator device 120 are shown in FIGS. 12*a*-12*c*. It can be seen that as the engagement part 138 rotates, it slides over the co-operating member 142. Eventually, as the actuator device 120 has been fully rotated, the abutment member 125 abuts the second end 123*b* of the channel 121 in the wall 33. At this point, the engagement part 138 will have moved past the whole length of the co-operating member 142 such that there is no longer any engagement between them. The cover member 18*a* will then pivot open to its second open position under the force applied by the biasing member 112. This is shown in FIG. 12*c*.

Any dirt contained in the dirt collection chamber 18 will then fall under gravity from the opening 108*a* into the waste container. Once the dirt collection chamber 18 has been emptied, the user may push the cover member 18*a* back to its first position and then rotate the actuator device 120 in an anti-clockwise direction to effect engagement between the engagement part 138 and the co-operating member 142. The cover member 18*a* is therefore retained in its first position and the user may release his or her grip from the cover member 18*a*. The user may continue to rotate the actuator device 120 until the abutment member 125 engages the first end 123*a* of the channel 121 to ensure that the actuator device 120 is securely attached.

If the user wishes, he or she may also remove the actuator device 120 and parts connected thereto as shown in FIG. 13 to service said parts, e.g. to clean or replace the filter 90 by pivoting open the lid 122 of the actuator device 120 to gain access to said parts.

The embodiments described have a number of advantages. The user can open the cover member 18*a* at a point remote from the cover member and so avoid dirt coming into contact with the user's hand. A rotational actuator device 120 is relatively easy to operate. Also, in embodiments, the user does not apply a force to open the cover member 18*a*, instead, rotation of the actuator device 120 causes the engagement part 138 to slide free of the co-operating member 142 and once they are separated, the biasing member 112 urges the cover member 18*a* open. In embodiments, there may be no biasing member 112 and the cover member 18*a* may fall open under gravity.

Embodiments according to the present invention advantageously use parts of the dirt separation device 15, e.g. lid 121, the second separating chamber 18*d*, shroud 100, the second dirt collection chamber 18*e* and cover member 18*a*, to include the operative parts of the actuator device 120 such that no additional parts, e.g. hooks, latches or rod members or the like, are required.

Embodiments according to the present invention having a dirt separation device including a cyclonic separator for which the actuator device is connected to a part of the separator so that rotation of the actuator device causes rotation of the said part advantageously cause any dirt within the separator and/or dirt collection chamber(s) to be agitated during rotation of the actuator device. Any such compressed dirt is thus loosened so that it readily falls out of the dirt collection chamber(s) when the cover member is opened for emptying. In embodiments, the actuator device and the part of the separator are connected by a steadfast connection to prevent relative movement therebetween. In embodiments, the part of the separator may include a shroud thereof. In embodiments, the part of the separator may include a dirt collection chamber thereof.

In embodiments, the actuator device 120 may not include the lid 112 and/or may be positioned elsewhere on the dirt separation device 15 and/or configured to open the cover member 18*a* differently. For some embodiments, all that is required is that the actuator device 120 rotates to open the cover member 18*a*, or an engagement part 138 connected to the actuator device 120 rotates to open the cover member 18. For some embodiments, the actuator device 120 may move differently and only the engagement part 138 rotates or moves along an arcuate path to open the cover member 18. For some embodiments, the actuator device 120 and/or engagement part 138 may not be connected to the separator 11. In some embodiments, the separator 11 may not include a second separating chamber and second dirt collection chamber, or any separating chambers (i.e. the separator 11 is a bag), and, instead, the actuator device 120 and engagement part 138 are provided elsewhere on the dirt separation device 15.

The present invention may be employed as part of a cylinder cleaner. For such a cleaner, its housing may support the suction source, the dirt separation device and, in normal use, the housing is supported on a floor surface and the elongate axis of the dirt separation device is parallel with the floor surface.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A dirt separation device for a surface cleaning apparatus comprising:

a separator for separating dirt from dirt-laden air;

an inlet through which dirt-laden air is drawn into the separator;

an outlet through which cleaner air exits the separator;

a dirt collection chamber for receiving separated dirt;

a cover member moveable between a first position in which the cover member inhibits access to the dirt collection chamber and a second position in which the cover member permits access to the dirt collection chamber;

an actuator device coupled to the cover member for effecting movement of the cover member from the first position to the second position;

a shroud;

wherein the actuator device is rotationally moveable, which causes rotation of the shroud, to effect movement of the cover member from the first position to the second position.

2. The dirt separation device according to claim 1 further comprising an engagement part, operably connected to the actuator device, is rotationally moveable, wherein the dirt separation device has an elongate axis A and the engagement part is rotationally moveable about the elongate axis A, and wherein the engagement part is positioned within the dirt collection chamber.

3. A dirt separation device according to claim 2, wherein the cover member includes a co-operating member for co-operating with the engagement part, wherein the co-operating member is positioned on an interior surface of the cover member that defines a portion of the dirt collection chamber.

4. The dirt separation device according to claim 1 wherein the dirt separation device includes opposing first and second ends, wherein the first end includes the actuator device and the second end includes the cover member, and wherein the actuator device closes an opening at the first end of the dirt separation device.

5. The dirt separation device according to claim 1 wherein the actuator device defines a portion of an air flow passage upstream of the separator, and wherein the actuator device includes a user graspable portion.

6. The dirt separation device according to claim 1 wherein the actuator device is connected to a part of the separator such that rotation of the actuator device causes rotation of the part of the separator, and wherein the actuator device and the part of the separator are connected by a steadfast connection to prevent relative movement therebetween.

7. A dirt separation device according to claim 6 wherein the separator is a cyclonic separator and the part of the separator is the shroud thereof.

8. The dirt separation device according to claim 1 wherein the separator is a cyclonic separator device including:

a first separating chamber fluidly connected to the inlet for separating coarse dust or debris from the dirt-laden air;

an inlet through which dirt-laden air is drawn into the first dirt separating chamber;

a first dirt collection chamber for receiving coarse dust or debris separated by the first separating chamber;

an outlet through which cleaner air exits the first separating chamber;

a second separating chamber for separating fine dirt from the dirt-laden air cleaned by the first separating chamber, a second dirt collection chamber in communication with the second separating chamber;

an outlet through which cleaner air exits the second separating chamber;

an inlet through which cleaned dirt-laden air exiting the first separating chamber is drawn into the second separating chamber.

9. A dirt separation device according to claim 8 wherein an engagement part is connected to or forms a part of the second dirt collection chamber.

10. A dirt separation device according to claim 9 wherein the second dirt collection chamber has a wall defining a space in which the fine dirt is collected and the engagement part is connected to or forms a part of the wall.

11. A dirt separation device according to claim 8 wherein the second separating chamber is positioned within the shroud, and the second separating chamber includes:

a frusto-conical portion with a central axis and the frusto-conical portion has an end part in communication with the second dirt collection chamber through which fine dirt exits therethrough into the second dirt collection chamber, and wherein the inlet of the second separating chamber is configured to direct the incoming said cleaned dirt-laden air such that cleaned dirt-laden air travels circumferentially around an inner surface of the frusto-conical portion, and wherein the second dirt collection chamber is connected to the second separating chamber in a steadfast manner to prevent relative movement therebetween.

12. The dirt separation device according to claim 1, wherein the dirt collection chamber is a first dirt collection chamber, further comprising a second dirt collection chamber, wherein the shroud separates the first dirt collection chamber from the second dirt collection chamber.

13. A dirt separation device according to claim 12 wherein the actuator device is connected to the second dirt collection chamber through a second separating chamber.

14. A dirt separation device for a surface cleaning apparatus comprising:

a separator for separating dirt from dirt-laden air;

an inlet through which dirt-laden air is drawn into the separator;

an outlet through which cleaner air exits the separator;

a first separating chamber fluidly connected to the inlet for separating dust or debris from the dirt-laden air;

a first dirt collection chamber for receiving separated dust or debris;

a second separating chamber for separating dirt or debris from the dirt-laden air cleaned by the first separating chamber;

a second dirt collection chamber in communication with the second separating chamber for receiving separated dirt or debris;

a cover member moveable between a first position in which the cover member inhibits access to the first dirt collection chamber and the second dirt collection chamber and a second position in which the cover member permits access to the first dirt collection chamber and the second dirt collection chamber;

an actuator device coupled to the cover member for effecting movement of the cover member from the first position to the second position;

an engagement part operably connected to the actuator device;

wherein the actuator device is connected to the second dirt collection chamber such that rotation of the actuator device causes rotation of the second dirt collection chamber, and wherein, when the actuator device and second dirt collection chamber are rotated, the engagement part moves along an arcuate path to effect movement of the cover member from the first position to the second position.

15. The dirt separation device according to claim 2 wherein the dirt separation device has an elongate axis A and the engagement part is rotationally moveable about the elongate axis A, and wherein the engagement part is positioned within the second dirt collection chamber.

16. A dirt separation device according to claim 15 wherein the engagement part is engagable with the cover member to retain the cover member in its first position.

17. The dirt separation device according to claim 2 wherein the cover member includes a co-operating member for co-operating with the engagement part, and wherein the co-operating member is positioned on an interior surface of the cover member that defines a portion of the second dirt collection chamber.

18. The dirt separation device according to claim 2 wherein the separator includes opposing first and second ends, wherein the first end includes the actuator device and the second end includes the cover member wherein the actuator device closes an opening at the first end of the dirt separation device.

19. The dirt separation device according to claim 2 wherein the actuator device defines a portion of an air flow passage upstream of the separator, and wherein the actuator device includes a user graspable portion.

20. The dirt separation device according to claim 2 wherein the actuator device is connected to a part of the separator such that rotation of the actuator device causes rotation of the part of the separator, and wherein the actuator device and the part of the separator are connected by a steadfast connection to prevent relative movement therebetween.

21. A dirt separation device according to claim 20 wherein the separator is a cyclonic separator and the part of the separator is the second dirt collection chamber thereof.

* * * * *